US007253782B2

(12) United States Patent
Davies

(10) Patent No.: US 7,253,782 B2
(45) Date of Patent: Aug. 7, 2007

(54) PHASE SHIFTING DEVICE

(75) Inventor: Christopher Davies, Cheltenham (GB)

(73) Assignee: Alan Dick & Company Limited, Cheltenham, Glos (GB)

( * ) Notice: Subject to any disclaimer, the term of this patent is extended or adjusted under 35 U.S.C. 154(b) by 0 days.

(21) Appl. No.: 10/519,634

(22) PCT Filed: Jun. 27, 2003

(86) PCT No.: PCT/GB03/02743

§ 371 (c)(1),
(2), (4) Date: Dec. 28, 2004

(87) PCT Pub. No.: WO2004/004059

PCT Pub. Date: Jan. 8, 2004

(65) Prior Publication Data

US 2005/0248494 A1 Nov. 10, 2005

(30) Foreign Application Priority Data

Jun. 29, 2002 (GB) ..... 0215087.8

(51) Int. Cl.
*H01Q 3/00* (2006.01)

(52) U.S. Cl. ..... 343/757

(58) Field of Classification Search ..... 343/700 MS, 343/803, 815, 818, 795, 757, 758, 761, 764, 343/765

See application file for complete search history.

(56) References Cited

U.S. PATENT DOCUMENTS

| | | | | |
|---|---|---|---|---|
| 5,440,318 | A * | 8/1995 | Butland et al. | 343/814 |
| 6,208,222 | B1 * | 3/2001 | Sinsky | 333/161 |
| 6,326,922 | B1 * | 12/2001 | Hegendoerfer | 343/700 MS |
| 6,650,291 | B1 * | 11/2003 | West et al. | 342/371 |
| 6,683,582 | B1 * | 1/2004 | Love | 343/853 |
| 6,850,130 | B1 | 2/2005 | Gottl et al. | |
| 6,987,487 | B2 * | 1/2006 | Zimmerman et al. | 343/757 |
| 2002/0167443 | A1 | 11/2002 | McKinzie, III et al. | |
| 2003/0016097 | A1 | 1/2003 | McKinzie, III et al. | |

FOREIGN PATENT DOCUMENTS

| | | |
|---|---|---|
| DE | 198 12 582 A 1 | 9/1999 |
| EP | 1 033 773 A1 | 9/2000 |
| GB | 1439893 | 6/1976 |
| WO | WO 01/03233 A1 | 1/2001 |
| WO | WO 01/13459 A1 | 2/2001 |
| WO | WO 03/036759 A1 | 5/2003 |

* cited by examiner

*Primary Examiner*—Shih-Chao Chen
*Assistant Examiner*—Minh Dieu A
(74) *Attorney, Agent, or Firm*—McDermott Will & Emery LLP

(57) ABSTRACT

This invention relates to a phase shifting device, which generally comprises of rigid chassis, in the form of an aluminum plate, which can form a ground plane for feed lines (12) printed on a printed circuit board (16), which is mounted on the chassis, a rigid RF transparent block, which is fixed to an actuator arm and mounting bolts for slidably mounting block and actuator on the chassis. A flexi circuit, or the equivalent, (18) is attached to the block and is printed with generally c-shaped conductive strips (23), which form connections at open parts of the feed lines, in such a manner that movement of the block will cause changes in the effective lengths of the feed lines (12) and hence the relative phases of antennas fed by those feed lines.

9 Claims, 4 Drawing Sheets

PHASE SHIFTING DEVICE

This application is a U.S. national filing under 35 U.S.C. 371 and claims priority from PCT/GB2003/002743, filed 27 Jun. 2003, and from British Application No. 0215087.8, filed 29 Jun. 2002 (each incorporated by reference herein).

This invention relates to a phase shifting device for an array of antenna elements and in particular, but not exclusively, to a ground-tilting antenna including such an array.

For a variety of reasons it may be desirable to induce and adjust the phase difference between signals emitted from a plurality of antenna elements in an array and one particular example of this is when the array forms a ground tilting antenna. It is well known by designers of wireless cell networks, such as mobile phone networks, that there is a continuous compromise to be made between coverage, capacity and quality. Maximum coverage is achieved by emitting a horizontal beam, but in periods of peak capacity it is found that there is often interference or calls simply dropping off, with such an arrangement. In general, therefore, antenna are tilted downwardly by about 5°. It has, however, been appreciated that even a fixed tilt is not ideal, because it does not allow for changes in usage within the cell either on a short-term basis or a long-term basis. Many aerials are therefore mounted on the system which can mechanically alter the tilt of the aerial, but these require an engineer to visit the site and they often require the antenna to be switched off during adjustment.

Proposals have, accordingly, been made to alter the tilt of the radiating beam electrically by inducing phase changes along the length of the array corresponding to tilts of various angles. However, these have tended to introduce their own mechanical and control complexities. For example, in WO 01/03233 a phase shift system is described in which the phase is altered by altering the line length for any given antenna by varying the insertion or withdrawal of generally C-shaped conductor portions lying within, but not touching, folded conductors that form part of the line. This requires fabrication and assembly to a fine degree of tolerance and the mechanical arrangements for achieving continuous adjustment of the phase in different senses in different parts of the array in a coordinated manner are complex. Other approaches are to use moveable dielectric bodies such as described in US-A-2002/0003458 or a slidable T-junction arrangement as described in U.S. Pat. No. 5,801,600. In each case the construction is complex and co-ordinated alteration of the phase shifts is difficult to obtain.

From one aspect the invention consists in the phase shifting device of an array of antenna elements having respective antenna feed lines formed on a printed circuit board with respective open circuits formed therein, the device including a body slidable relative to the printed circuit board and carrying a plurality of conductive strips for forming a RF connection across respective open circuits, the strips being formed such that any given feed line is lengthened by movement of the element in one direction and shortened by movement in an opposite direction.

Conveniently the conductive strips are generally C-shaped and there may be one set of conductive strips which are oppositely sensed from another set, such that on movement in one direction, the one set of strips moves to lengthen their respective feed lines, whilst the other set shorten their respective feed lines. The conductive strips are preferably capacitively connected to their respective feed lines.

The body is preferably a rigid RF transparent block and the conductive strips may be printed on the surface of the block or they may be formed on a circuit that is fixed to the block, with the body of the circuit interposed between the block and the printed circuit board so that there is no friction on the conductive strips to damage them. A lamination process may be used. Alternatively a thin dielectric sheet or coating may be interposed.

SUMMARY OF INVENTION

The invention further includes a phase changing assembly including a printed circuit board for an array of antenna elements, the board having respective antenna element feed lines formed thereon, each feed line having an open circuit formed therein, a phase shifting device as claimed in any one of the preceding claims with the body slidably mounted with respect to the printed circuit board and an actuator for causing slidable movement.

Preferably the printed circuit board is elongate and the body is moveable in the longitudinal axial path, which incorporates the one and the other direction movement defined above.

The invention still further includes a ground tilting antenna array comprising assembly as claimed above where the antenna elements are mounted in the vertical elongate array with the upper antenna elements connected to the feed lines whose length is lengthened when the body is moved in the one direction and the lower antenna elements connected to the feed lines whose length is shortened when the body is moved in the one direction whereby a phase shift can be caused along the length of the array.

Although the invention has been defined above it is to be understood that it includes any inventive combination of the features set out above or in the following description.

BRIEF DESCRIPTION OF THE DRAWINGS

The invention may be performed in various ways and specific embodiments will now be described by way of example with reference to the accompanying drawings, in which.

DETAILED DESCRIPTION OF PREFERRED EMBODIMENTS

Figure 5:
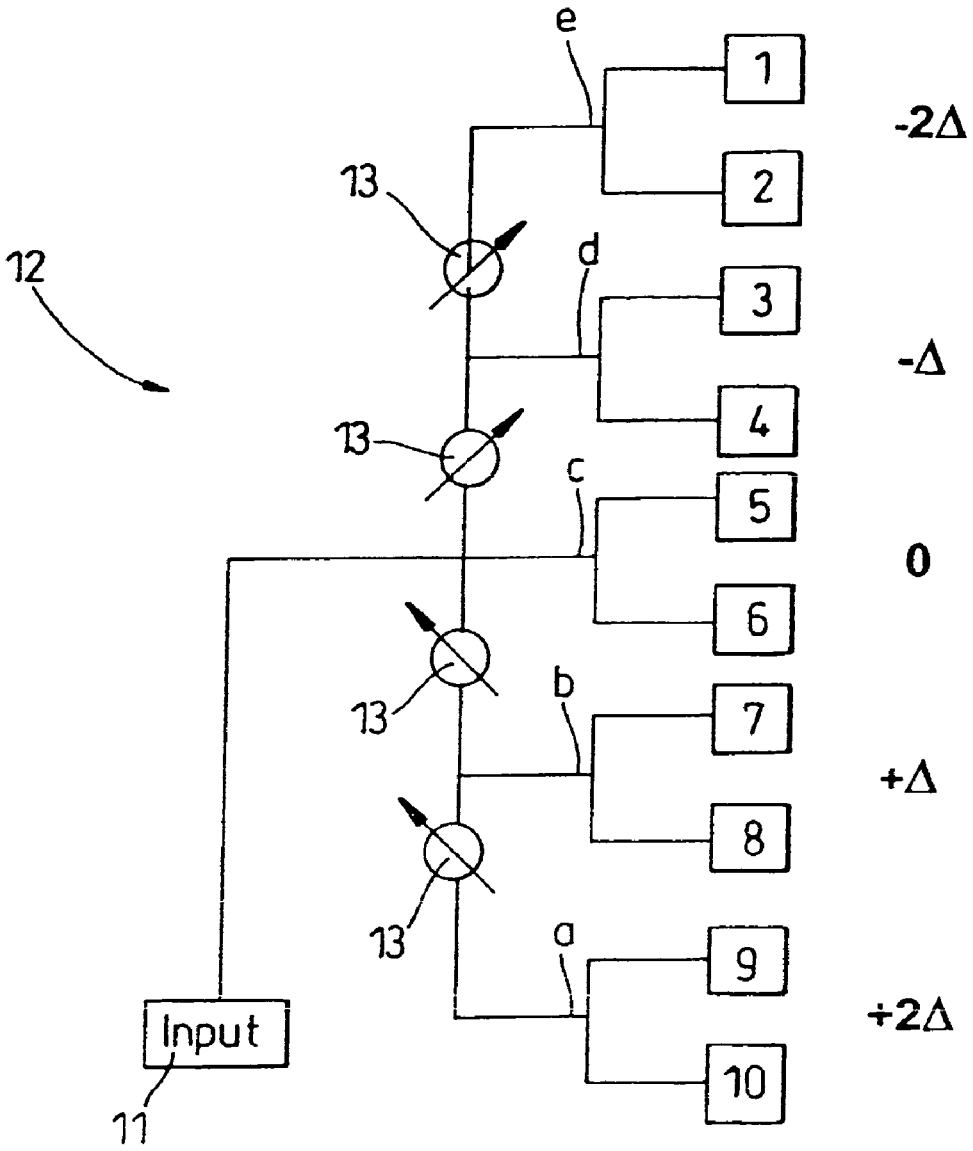
FIG. 5 is a schematic view of an antenna array.

Turning to FIG. 5, the antenna elements, which form an array 1 to 10, from one side of a dual polar array are schematic illustrated. A corresponding set (not shown) will be provided in a dual polar array to radiate the other polarization. The elements 1 to 10 are arranged in pairs and each pair (eg 1,2) radiates with the same phase. The antenna elements 1 to 10 are connected to an input 11 by bifurcating feed lines 12 that include phase shifting devices 13, which are located in the feed lines 12 so that a respective individual phase shift, with respect to the pair 5,6, can be induced in each other pair of antenna elements. Thus, in the arrangement indicated in FIG. 5, if antenna elements 5,6 are taken to have zero phase, antenna elements 3,4 are shifted in the negative sense by one phase unit, whilst 1,2 are shifted negatively by two phase units. Conversely, 7,8 are positively shifted by one phase unit and 9,10 are positively shifted by two phase units. By inducing a phase distribution of this type along the array one can vary the effective down tilt of a ground-tilting antenna, which is nominally electrically pre-set (by means of phased cable lengths) at a 5° down tilt, from between 0 to +10°.

Turning now to FIGS. 1 to 4, the Applicants' preferred construction for obtaining such a phase shift will be described.

Figure 1:
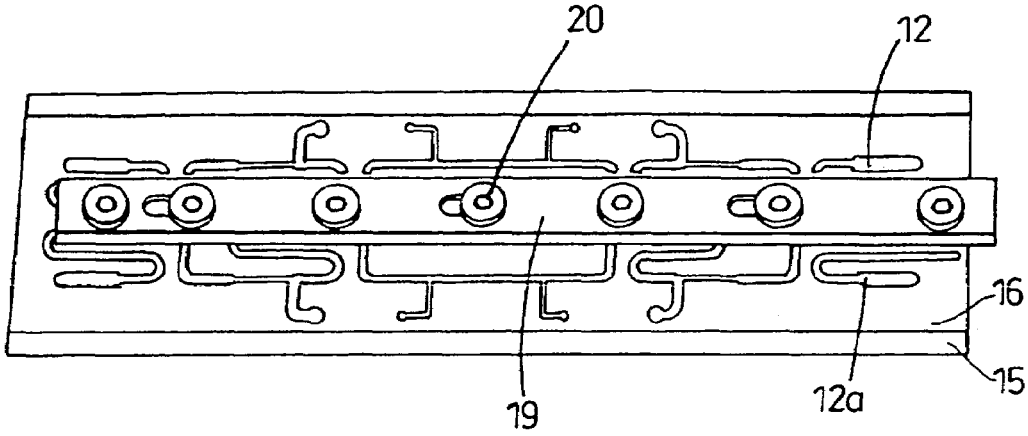
FIG. 1 is a view from above of the main operative portion of a phase changing assembly.
Figure 2:
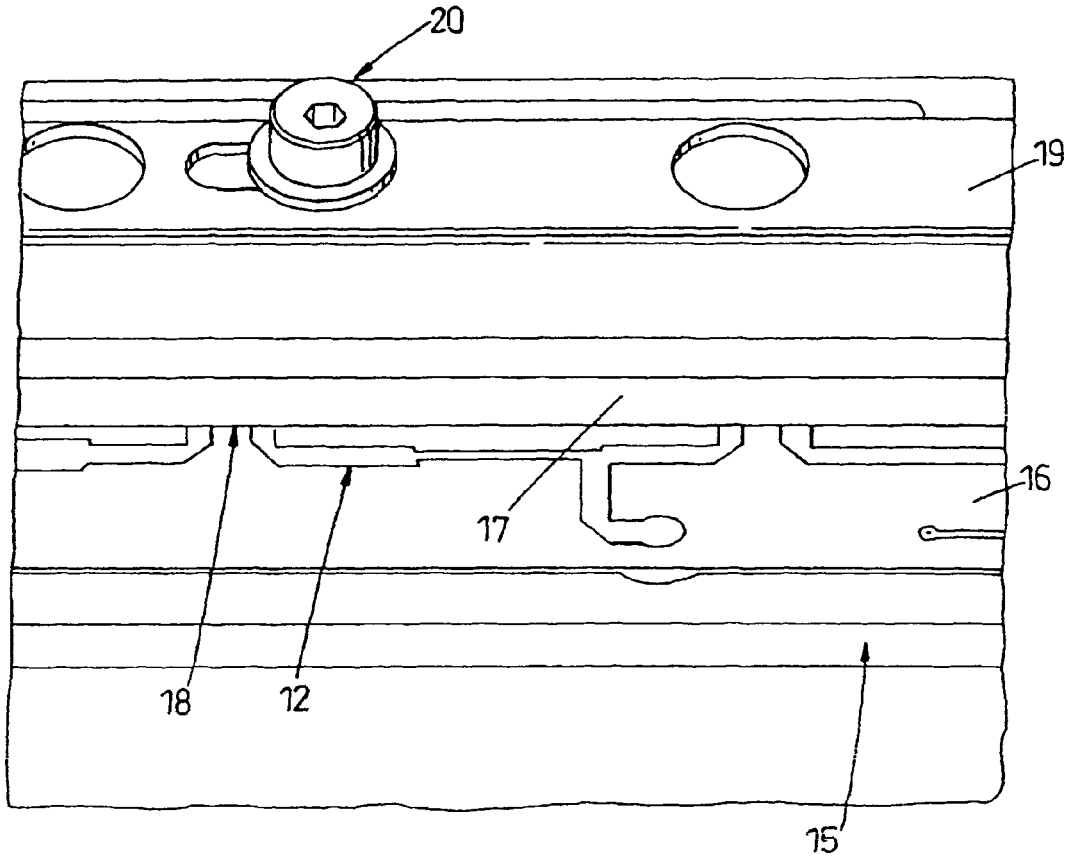
FIG. 2 is an enlarged view from above and to one side of the assembly.

As can best be seen in FIGS. 1 and 2, a phase shifting device is generally indicated at 14 and generally comprises a rigid chassis 15, in the form of an aluminum plate, which can form a ground plane for the feed lines 12 pinned on a printed circuit board 16 which is mounted on the chassis 15, a rigid RF transparent block, eg of polycarbonate, or a circuit substrate 17, which is fixed to an actuator arm 19 and mounting bolts 20 for slidably mounting the block 17 and actuator 19 on the chassis 15. A circuit 18, which can be a flexi circuit can just be seen attached to the block 17; this may also be etched back into the block 17.

Figure 3:
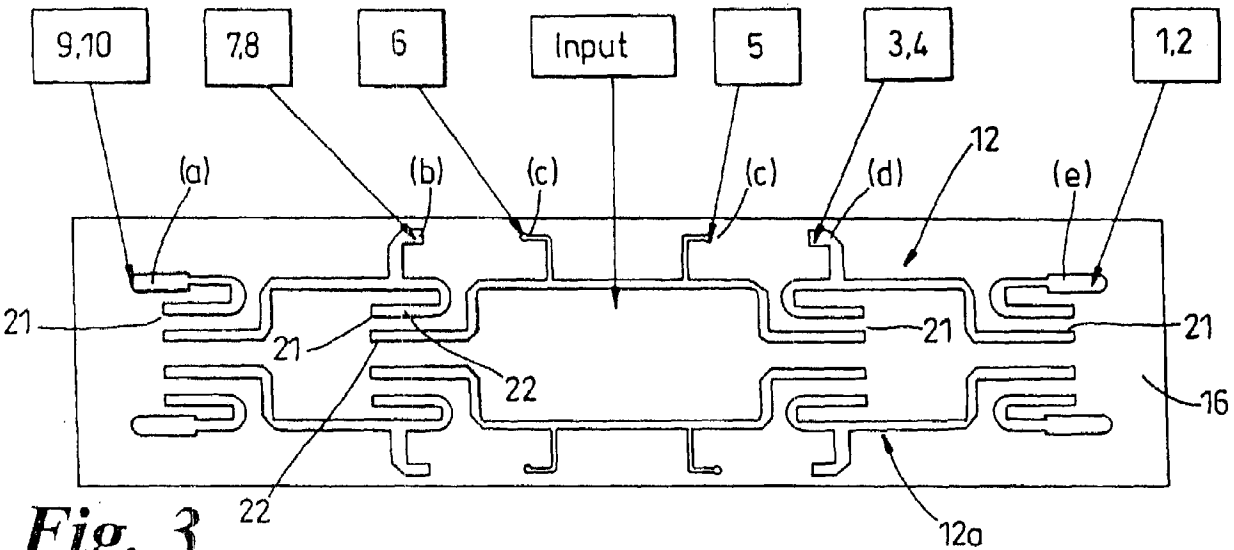
FIG. 3 is a view from above of the printed circuit board of the assembly.

Turning to FIG. 3, feed lines 12 are shown printed on the printed circuit board in a conventional manner. They can be microstrip as illustrated or stripline or coplanar wave guides or any other suitable transmission line. The lines may be printed, etched or formed on the board 16. It will be seen that the feed lines patterns 12 are completely symmetrical, to accommodate the dual polar antenna array and the arrangement will be described in connection with one side of the array only. As with FIG. 5, a duplicate set of antenna elements, operated on the opposite polarization, would be connected to the corresponding points on the other set of feed lines 12*a*. As can be seen, each antenna element is attached to a connection point, which are identified by respective letters a to e and these corresponding points are marked on the FIG. 5. Upstream of points a, b, d and e are respective open circuits 21 which are constituted by a gap between two parallel sections of track 22. It will be noted that the parallel tracks 22, which are connected to points a and b, point in the opposite direction to those connected to points a and e and that in all cases they lie parallel to the longitudinal axis at the elongate printed circuit board 16.

Figure 4:
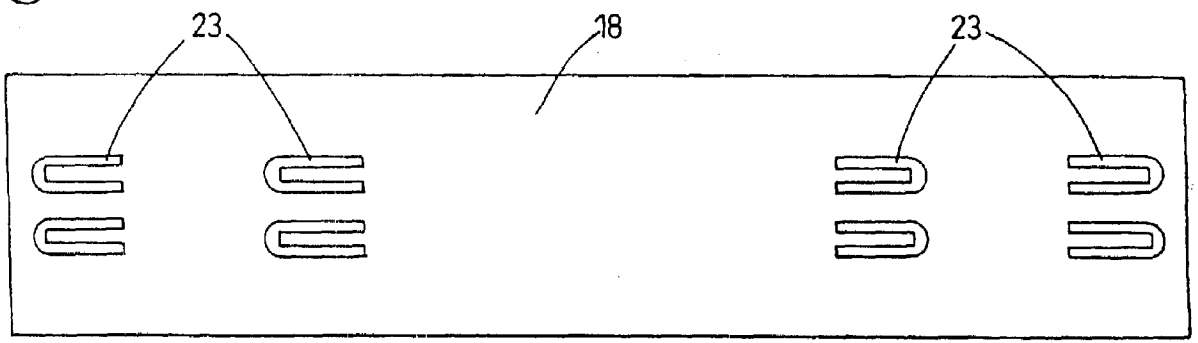
FIG. 4 is a view from above of the slider circuit of the assembly.

Turning to FIG. 4, the slider circuit 18 carries generally C-shaped conductive strips 23. It will be noted that each strip 23 points towards the centre of the slider circuit 18 and so those at the left hand side face oppositely to those at the right hand side. As is indicated in FIG. 2, this circuit 18 is adhered along the underface of the rigid block 17. Thus it is held in a position where the strips 23 overlie the arms 22 to form a capacitive RF connection across the open circuits 21 and it will further be understood that the degree to which the arms of the strips 23 overlie the arms 22 determines the length of the feed line at that particular point and hence the phase shift created by the feed line. Accordingly, by sliding the rigid block 17 and hence the circuit 18 axially with respect to the printed circuit board the length of the feed lines connecting to points a, b, d and e can be lengthened or shortened dependent on the extent and direction of that movement. Thus if the block 17 moves from right to left the feed line connecting to points a and b are extended as the strips 23 move relative to the arms 22 in the manner of a slide being pulled out on a trombone, whilst at the same time, because of the opposite sensing of the strips 23 on the right hand side of the circuit 18, the feed lines connected to points d and e are effectively shortened, as is the air path in the trombone when the slide is pushed into the tubing. Thus when that movement takes place the phase shifts indicated in FIG. 5 occur. As the movement is taking place with a single block the phase change relative to each portion of the feed line 12 is the same and so the stepped phase changes indicated in FIG. 5 are readily and routinely obtained. Alternatively the phase changes are continuous.

It will be noted that the only movement that needs to be achieved is the movement of the single block 17 and so no complex ganging or gearing needs to take place, nor is there any chance of mechanical wear or slackness introducing error. As the circuit 18 is adhered to the rigid block 17 with the conductive strips 23 adjacent the block 17 all the sliding takes place on the undersurface of the circuit, which can be coated with PTFE and the strips 23 are not subjected to wear. The upper surface of the printed circuit board 16 can also be lubriciously protected by being covered with a thin PTFE layer.

The rigid block 17 can be mounted in any suitable manner, but the Applicants have found that the arrangement illustrated is particularly convenient. This comprises a number of bolts 20 which are screwed through openings in the printed circuit board 16, into the chassis 15 along the central axis thereof. These bolts extend through slots 24 in the arm 19 to define precise linear travel for the arm 19 and hence the block 17. The bolts can be adjusted so that there is sufficient friction between the underside of the slider circuit 18 and the printed circuit board 17 for any particular position to be retained frictionally. Continuous adjustment of the phase is therefore available. Preferably the linear movement of the arm 19 is achieved by a stepper motor (not shown) acting on a remote end thereof so that the phase shift can be adjusted remotely, so the effective ground tilt angle of the array can be achieved, either at ground or, even more preferably, from a remote control station. Often the adjustment will be made to reflect changing traffic profiles over a period of weeks or months, but the system is equally capable of allowing changing angles throughout a pre-set daily pattern, in the manner of traffic light delays, so that, for example, antennas near roads, carrying rush hour traffic, may require a greater down tilt during peak periods than at other times or, it could be a real time adjustment which reflects the traffic being handled by any particular array at any particular time.

The circuit illustrated is designed for 1710 to 2170 MHz wideband operation, when connected to wideband antenna elements. However, it can be scaled to other frequency bands eg 800 MHz to 1 GHz, by those skilled in the art.

The invention claimed is:

1. A phase shifting device for an array of antenna elements having respective antenna feed lines, formed on a printed circuit board, with respective open circuits formed therein, the device comprising:

a body slidable relative to the printed circuit board and carrying a first plurality of conductive strips and a second plurality of oppositely sensed conductive strips forming an RF connection across respective open circuits, the first and second plurality of conductive strips being formed at spaced locations on the body, wherein when the body moves in a first direction a phase length associated with a first open circuit of the first plurality of conductive strips is lengthened and a phase length associated with a second open circuit is shortened, the second open circuit being overlaid by the second plurality of conductive strips.

2. The device as claimed in claim 1 wherein at least one of the first and second plurality of conductive strips are capacitively connected to their respective feed lines.

3. The device as claimed in claim 1 wherein the body is a rigid RF transparent block.

4. The device as claimed in claim 3 wherein at least one of the first and second plurality of conductive strips are printed, etched or formed on a surface of the block.

5. The device as claimed in claim 3 wherein at least one of the first and second plurality of conductive strips are mounted on a circuit that is fixed to the block with the body of the circuit interposable between the block and the printed circuit board.

6. The device as claimed in claim 1 further including a low friction thin dielectric layer interposed between engaging surfaces of the board and the conductive strips.

7. The device as claimed in claim 1 further comprising an actuator for causing the slidable movement and wherein the antenna element is slidably mounted with respect to the printed circuit.

8. The device as claimed in claim 7 wherein the printed circuit board is elongate and the body is movable in a longitudinally axial path.

9. A ground tilting antenna array comprising:

a phase shifting device comprising:

a body slidable relative to a printed circuit board; and, a plurality of oppositely sensed antenna elements mounted to the circuit board in a vertical elongate array and defining upper antennae and lower antennae, the upper antennae being connected to feed lines that are lengthened when the body is moved in a first direction and the lower antenna elements being connected to the feed lines that are shortened when the body is moved in the first direction, whereby a phase shift is caused along the length of the array.

* * * * *